United States Patent [19]

Pinto

[11] Patent Number: 4,517,700

[45] Date of Patent: May 21, 1985

[54] ADJUSTABLE SCRAPER TOOL

[75] Inventor: Joseph G. Pinto, Salisbury, Md.

[73] Assignee: The Sherwin-Williams Company, Cleveland, Ohio

[21] Appl. No.: 640,912

[22] Filed: Aug. 15, 1984

Related U.S. Application Data

[63] Continuation of Ser. No. 438,138, Nov. 1, 1982.

[51] Int. Cl.[3] ..... B05C 17/00

[52] U.S. Cl. ..... 15/105; 15/111; 15/144 R; 15/236 R; 16/110 R; 51/392

[58] Field of Search ..... 15/111, 114, 143 R, 15/105, 117, 118, 172, 209 R, 210 R, 144 R, 236 R; 16/110 R, DIG. 24; 294/57; D4/10, 11, 12; 51/392, 393, 205 R

[56] References Cited

U.S. PATENT DOCUMENTS

| | | | |
|---|---|---|---|
| 959,211 | 5/1910 | Flach | 15/144 R |
| 1,462,829 | 7/1923 | Roberts | 15/111 |
| 3,413,043 | 11/1968 | Bertolina | 15/144 R |
| 4,059,864 | 11/1977 | Spresny | 15/105 |

FOREIGN PATENT DOCUMENTS

| | | | |
|---|---|---|---|
| 243821 | 1/1947 | Switzerland | 15/144 R |
| 109001 | 8/1917 | United Kingdom | 15/144 R |
| 846413 | 8/1960 | United Kingdom | 15/144 R |
| 0694228 | 12/1979 | U.S.S.R. | 15/144 R |

*Primary Examiner*—Edward L. Roberts

*Attorney, Agent, or Firm*—James V. Tura; Robert E. McDonald; David B. Deioma

[57] ABSTRACT

An adjustable tool is provided which includes a selectively positionable and lockable handle. The tool includes a main housing having a handle shaft axially directed transversely of the housing and a handle being rotatably mounted to the handle shaft for selective rotational movement about the handle shaft. The handle shaft has a threaded portion and threadedly advanceable thumbwheel at one end and a handle retaining pad at an opposite end. The handle is interposed between the thumbwheel and the retaining pad for compressive retention between them. The retaining pad includes a locking member comprising a protrusion for nesting reception in a locking member receiving port of the handle whereby upon advancement of the thumbwheel the handle is compressively retained between the thumbwheel and the retaining pad and the locking member protrusion is received in the receiving ports for locking the handle in a selected position relative to the main housing.

5 Claims, 6 Drawing Figures

ADJUSTABLE SCRAPER TOOL

This application is continuation of application Ser. No. 438,138, filed Nov. 1, 1982.

BACKGROUND OF THE INVENTION

This invention pertains to the art of tools for applying and removing paint and, more particularly, to paint scraping and applying tools including selectively adjustable handle devices.

Versatility in painting and scraping a variety of objects has made it desirable to employ a tool for such processes which may be selectively adjustable for ease of operation and convenience. Various forms and types of adjustable painting and scraping tools have heretofore been suggested and employed, all with varying degrees of success. Typically, these prior tools have variously comprised painting and scraping instruments including handle devices that may be mounted to the instrument in several angular positions but require disassembly and reassembly to adjust the handle from one position to another. It has been found that disassembly in order to adjust the handle position is particularly inconvenient and, in addition, results in a tool which is susceptible to accidental disassembly upon prolonged exposure to the severe operating conditions to which a scraping tool is normally subjected. In addition, where disassembly is required to adjust the handle position of a painting tool during the painting operation, disassembly may be undersirable due to the presence of wet paint upon the tool.

The present invention contemplates a new and improved device which overcomes all of the above referred to problems and others to provide a new adjustable tool which is simple in design, economical to manufacture, readily adaptable to a plurality of uses with scraping and painting instruments having a variety of dimensional characteristics and which is easy to adjust and lock in a variety of handle positions.

BRIEF SUMMARY OF THE INVENTION

In accordance with the present invention, there is provided an adjustable tool including a housing and an adjustable handle operatively connected thereto. The housing has a bottom wall and a handle shaft. The bottom wall is sized for reception of a pad and the handle shaft is exposed for reception of the adjustable handle. The shaft further includes a locking member for locking the handle in a preselected position. A thumbwheel is also received on the handle shaft for selective advancement in a direction towards the locking member for compressive retention of the handle therebetween. The handle includes a shaft through-hole for reception of the handle shaft and a plurality of locking member receiving ports. The ports are sized for mating reception of the locking member. Means are provided for attachment of a scraper and/or a paint pad to the tool. In operation, advancement of the thumbwheel upon the shaft urges the locking member into locking reception in one of the plurality of locating ports for locking the handle in the preselected position relative to the housing.

In accordance with another aspect of the present invention, the locking member comprises a retaining pad including a locking protrusion at one end portion. The thumbwheel is received on the handle shaft at the other end portion. The pad and the thumbwheel are sized for compressive retention of the handle.

In accordance with a further aspect of the present invention, the retaining pad and the locking protrusion are fixed relative to the housing and the thumbwheel is rotatable with threaded advancement upon the shaft. The handle is sized such that upon retreat of the thumbwheel the locking protrusion may be disassociated from the locking member receiving ports for rotatable movement of the handle relative to the shaft and selection of a handle position.

In accordance with a more limited aspect of the present invention, the means for attachment of a scraper to said tool comprises a receiving slot included in the handle sized for close reception of a scraper.

One benefit obtained by use of the present invention is an improved adjustable tool which provides improved convenience in adjustment in operation.

Another benefit obtained from the present invention is an adjustable tool including a selectively positionable and lockable handle.

A further benefit of the present invention is an adjustable scraper tool which will absorb impacts and blows incident to scraping operation, yet maintain the selected adjusted position for operation.

Other benefits and advantages of the subject new adjustable tool will become apparent to those skilled in the art upon a reading and understanding of this specification.

BRIEF DESCRIPTION OF THE DRAWINGS

The invention may take physcial form in certain parts and arrangement of parts, the preferred embodiment of which will be described in detail in this specification and illustrated in the accompanying drawings which form a part hereof and wherein.

DETAILED DESCRIPTION OF THE INVENTION

Figure 1:
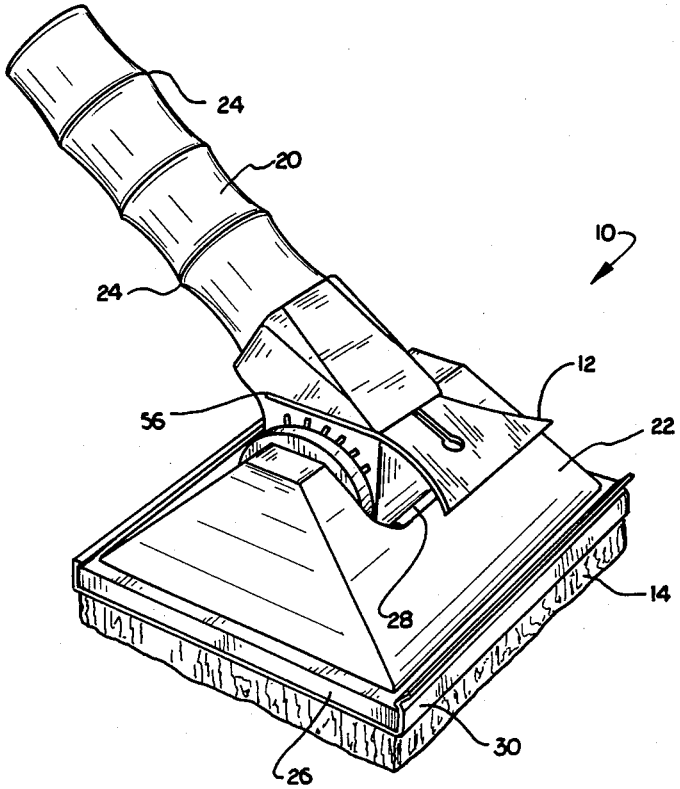
FIG. 1 is a perspective view of an adjustable scraper and painting tool formed in accordance with the present invention.

Referring now to the drawings wherein the showings are for purposes of illustrating the preferred embodiment of the invention only and not for purposes of limiting same, the FIGURES show an adjustable tool 10 particularly suited for receiving a scraping instrument 12 and a readily releaseable and attachable pad 14 which may be employed as a painting pad or for mounting and supporting sandpaper to the tool 10.

Figure 2:
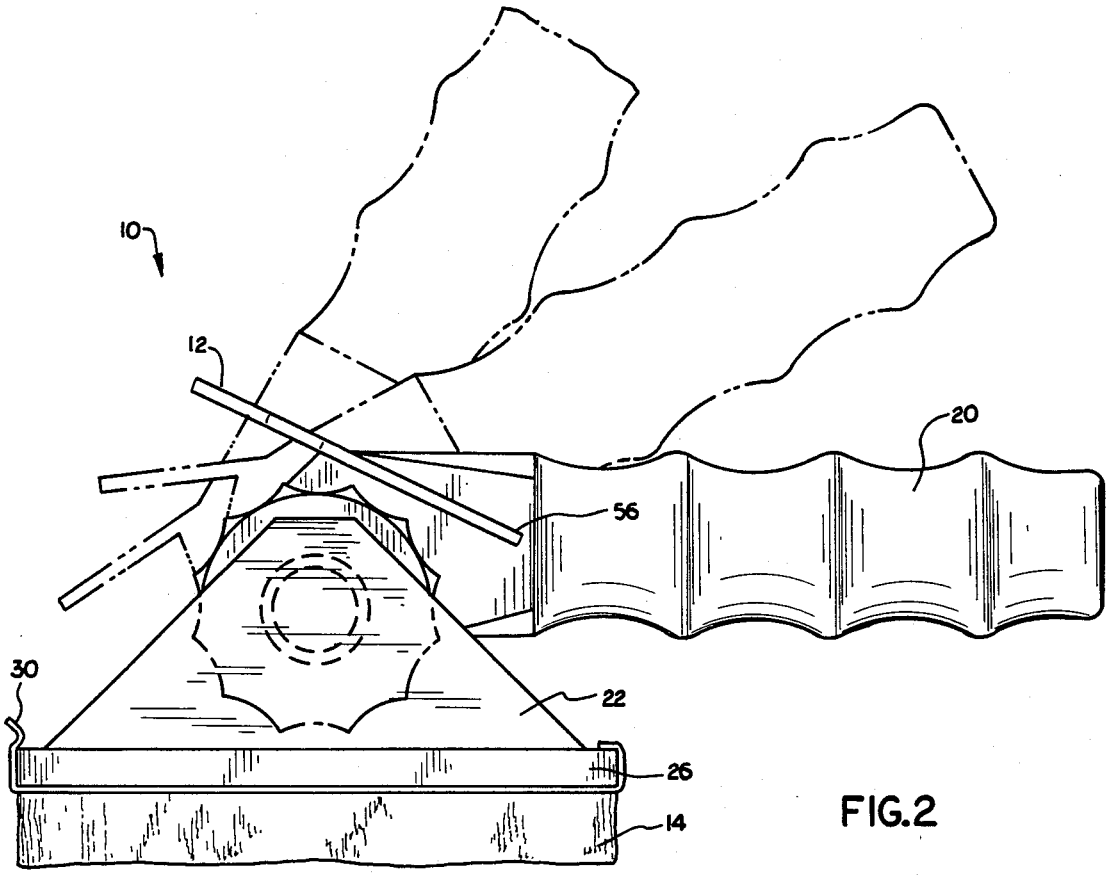
FIG. 2 is a side elevational view of the invention particularly showing the handle in several selected and adjusted positions.
Figure 3:
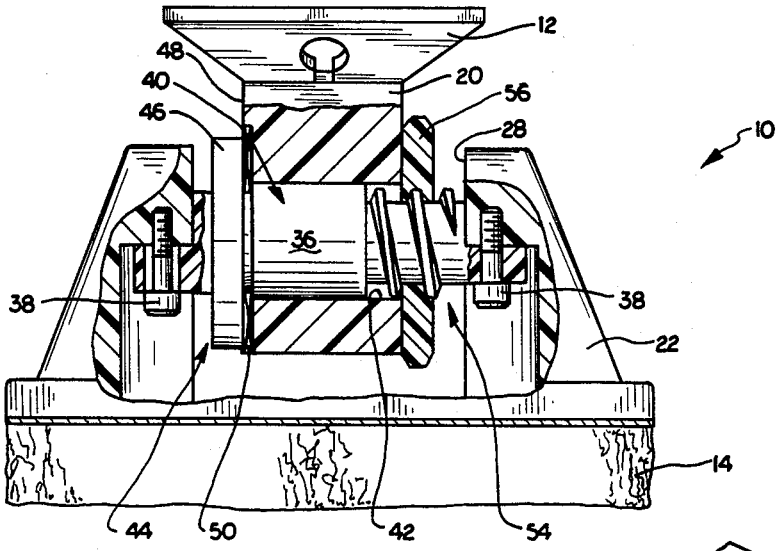
FIG. 3 is an end view in partial section of the invention shown in a locked position.
Figure 5:
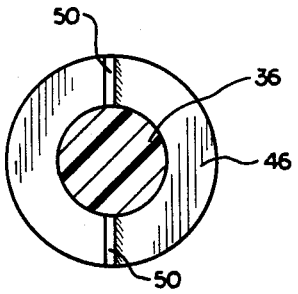
FIG. 5 is a cross-sectional view taken along line 5—5 of FIG. 4; and, FIG. 6 is a partial cross-sectional view taken along line 6—6 of FIG. 4.

More specifically, and with reference to FIGS. 1 and 2, tool 10 includes a selectively positionable and lockable handle 20 and a main housing 22. Handle 20 is preferably an elongated cylinder including a plurality of raised circumferential portions 24 to provide for comfort and grip of handle 20 in the hand of a user of tool 10. An axially extending threaded bore (not shown) is included in handle 20 for receiving an extending item such as a pole or stick for extending the length of handle 20. Housing 22 may be of a variety of dimensional configurations but is shown as a prismatoid including a bottom wall 26 and a generally centrally positioned undercut 28. Bottom wall 26 is preferably sized for close reception of pad 14 and preferably a clip-on support member 30 may be advantageously employed for this purpose. Undercut 28 is sized for reception of handle 20. Both housing 22 and handle 20 are constructed of a rigid durable material and preferably a hard plastic material, though even wood may be utilized.

With particular attention to FIGS. 3 through 6, housing 22 further includes a handle shaft 36 fastened to housing 22 with conventional fastening devices 38 to prevent movement of the shaft relative to the housing. Handle shaft 36 is generally directed transversely of the housing 22 to allow rotation of handle 20 about the axis of shaft 36 generally toward and away from the plane of the bottom wall 26 of the housing 22. Handle shaft 36 is exposed in undercut 28 for generally unimpaired reception of handle 20. A shaft through-hole 42 of handle 20 is sized for close reception of an intermediate portion 40 of handle shaft 36. One end portion of shaft 36 includes a retaining pad 46 having a diameter greater than the diameter of shaft through-hole 42 for abutting an associated one side wall 48 of the handle 20. Retaining pad 46 is fixed relative to housing 22 and includes a locking member preferably comprising protrusions 50 (FIG. 5) which are configured for close and locking reception in locking member receiving ports or grooves 52 of handle side wall 48 for locking handle 20 in a preselected position. Protrusions 50 may be received in a selected set of a plurality of co-linear grooves 52 to lock the handle 20 against rotation about handle shaft 36. The other end portion 54 of handle shaft 36 is threaded to receive a thumbwheel 56 for selective threaded advancement and retreat on shaft 36 to compressively retain the handle 20 between retaining pad 46 and thumbwheel 56 and to lock protrusions 50 in a selected set of grooves 52. The handle 20 is thus locked in a selected position defined by the reception of protrusion 50 in the particular set of grooves 52. It has been found that such locking and compressive retention sufficiently fixes the handle 20 relative to housing 22 to substantially eliminate problems of accidental shifting of the handle over prolonged periods of usage in the severe working conditions typical of paint scraping.

Figure 4:
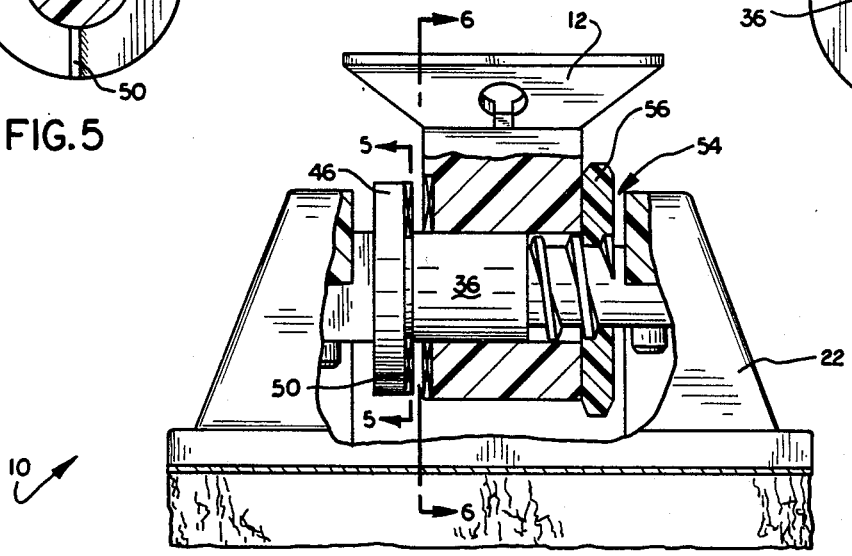
FIG. 4 is an end view of the invention in partial section showing the handle in an unlocked position.

With particular reference to FIGS. 2 and 4, it may be seen that when it is desirable to adjust the handle 20 to a different position, thumbwheel 56 may be loosened to allow the handle 20 to slide on handle shaft 36 away from retaining pad 46 and thereby allow withdrawal of protrusions 50 from grooves 52. Handle 20 may then be freely rotated about handle shaft 36 until an alternate angular position of the handle 20 relative to the housing bottom wall 26 is obtained (FIG. 2). Handle 20 may then be directed back towards fixed retaining pad 46 such that the protrusions 50 are nested in the alternate set of protrusion receiving ports 52 defining the alternate angular position. Thumbwheel 56 is then advanced towards retaining pad 26 to compressively retain the handle 20 therebetween and to lock the protrusions 50 in ports 52 and thereby lock the handle member 20 in the alternate selected position. It is a particular feature of the invention that tool 10 is easily and conveniently adjustable without disassembly of the device. Ready adjustment with one hand may even be accomplished in the course of painting or scraping.

Figure 6:
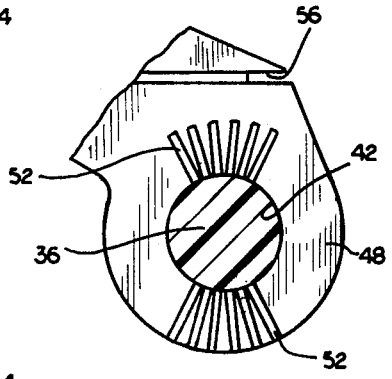

With reference to FIGS. 1, 2 and 6, scraping instrument 12 is preferably received in a receiving slot 56 of handle 20 sized for close, retentive reception of scraper 12. It is within the scope of the invention to employ a variety of sizes of scraping instruments with tool 10, which may be readily removed and inserted in slot 56 according to the desires of the user of the tool.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

What is claimed is:

1. An adjustable scraping and sanding tool including a housing, an adjustable handle operatively connected thereto and a pad releasably attached to the housing, the housing having a bottom wall about the periphery of the housing, the wall sized for releasably receiving a painting or a sanding pad, the housing having a generally prismatoidal configuration and a substantially centrally positioned undercut, the housing including a handle shaft substantially within the centrally positioned undercut but being exposed for reception of the handle, the handle shaft including a retaining pad having a diameter greater than the diameter of the shaft, the handle shaft further including a thumbwheel with an internally threaded opening, the handle shaft having a threaded portion along its length, spaced from the retaining pad to threadedly engage the thumbwheel, whereby the thumbwheel is rotatable on the shaft toward and away from the retaining pad in order to compressively retain the handle, the thumbwheel being substantially within the undercut but exposed therefrom, the handle including a shaft through-hole for rotatable reception of the shaft between the retaining pad and the thumbwheel, at least one locking protrusion on one of the retaining pad and the handle and a plurality of grooves in the other for mating reception of the retaining pad and the handle, the handle further having a receiving slot for close reception of a scraper, a scraper closely received in the receiving slot, the pad including a clip-on support member so that the pad may be releasably attached to the bottom walls of the housing whereby the angle of the handle of the tool may be manually adjusted relative to the housing with one hand by rotating the thumbwheel away from the retaining pad until the protrusion no longer engages a groove, angularly moving the handle relative to the housing and then rotating the thumbwheel so that it moves toward the retaining pad thus causing the protrusion to move into one of the grooves.

2. The tool as claimed in claim 1 wherein the handle has an axially extending threaded bore in the end of the handle opposite the end connected to the housing for receiving an extending item.

3. The tool as claimed in claim 2 wherein the handle has raised portions along its length to aid in gripping.

4. The tool as claimed in claim 1 wherein the pad is a sanding pad.

5. The tool as claimed in claim 1 wherein the pad is a painting pad.

* * * * *